US008973764B2

(12) United States Patent
Lynch

(10) Patent No.: US 8,973,764 B2
(45) Date of Patent: Mar. 10, 2015

(54) SAMPLE DISPLAY HOLDER

(71) Applicant: Anthony James Lynch, Lake Forest, CA (US)

(72) Inventor: Anthony James Lynch, Lake Forest, CA (US)

( * ) Notice: Subject to any disclaimer, the term of this patent is extended or adjusted under 35 U.S.C. 154(b) by 0 days.

(21) Appl. No.: 14/331,042

(22) Filed: Jul. 14, 2014

(65) Prior Publication Data

US 2015/0014260 A1 Jan. 15, 2015

Related U.S. Application Data

(60) Provisional application No. 61/845,636, filed on Jul. 12, 2013.

(51) Int. Cl.

| | |
|---|---|
| ***A47F 7/16*** | (2006.01) |
| ***A47F 1/12*** | (2006.01) |
| ***A47F 7/00*** | (2006.01) |
| ***A47F 3/02*** | (2006.01) |
| ***G09F 5/02*** | (2006.01) |

(52) U.S. Cl.

CPC . *A47F 7/163* (2013.01); *A47F 1/12* (2013.01); *A47F 7/0014* (2013.01); *A47F 3/02* (2013.01); *G09F 5/02* (2013.01)

USPC ..... 211/45

(58) Field of Classification Search

CPC ..... A47F 7/14; A47F 7/143; A47F 7/146; A47F 7/16; A47F 7/163; A47F 1/12; A47F 7/0014; A47F 3/02; G09F 5/02; G09F 5/04

USPC ..... 211/45, 59.1, 57.1; 40/600, 661.01; 206/425, 818, 460; 248/683, 206.5, 248/309.4, 507

See application file for complete search history.

(56) References Cited

U.S. PATENT DOCUMENTS

| | | | | |
|---|---|---|---|---|
| 4,736,853 | A * | 4/1988 | O'Mara | 211/88.01 |
| 4,838,436 | A * | 6/1989 | Bailey | 211/51 |
| 5,307,579 | A * | 5/1994 | Clayton et al. | 40/600 |
| 6,431,357 | B1 * | 8/2002 | Su | 206/425 |
| 6,435,355 | B1 * | 8/2002 | Brown | 211/44 |
| 7,059,482 | B2 | 6/2006 | Reid et al. | |
| 7,097,049 | B1 | 8/2006 | Singer et al. | |
| 2008/0149279 | A1 * | 6/2008 | Leighty et al. | 160/10 |
| 2010/0326865 | A1 * | 12/2010 | Maistrellis | 206/459.5 |
| 2012/0144708 | A1 | 6/2012 | Schwartz | |
| 2014/0165434 | A1 * | 6/2014 | Lynch | 40/446 |

OTHER PUBLICATIONS

International Search Report dated Nov. 10, 2014 from corresponding international application PCT/US2014/046560 USPTO PCT Division/ Authorized Officer Blaine R. Copenheaver.

* cited by examiner

*Primary Examiner* — Joshua Rodden
*Assistant Examiner* — Hiwot Tefera
(74) *Attorney, Agent, or Firm* — Plager Schack LLP

(57) ABSTRACT

A sample display holder is configured to present a fabric covering. The sample display holder includes a backer board, mechanically coupled to a plurality of joined cellular material sample sections further including a rear cellular material sample section mechanically coupled to the backer board and a front cellular material sample section mechanically coupled to a label. Each cellular material sample section further includes a cell mechanically coupled to and surrounded by the fabric covering. Each cell and each fabric covering further includes a front hole and a rear hole wherein all holes are aligned. A magnetic unit is attached to the backer board and further including a mounting mechanically coupled to a magnet. A magnetic plate is mechanically coupled to the front cellular material sample section. The plurality of joined cellular material sample sections can be compressed by magnetically coupling the magnet to the magnetic plate.

4 Claims, 4 Drawing Sheets

SAMPLE DISPLAY HOLDER

RELATED APPLICATION

This application claims priority to provisional patent application U.S. Ser. No. 61/845,636 filed on Jul. 12, 2013, the entire contents of which is herein incorporated by reference.

BACKGROUND

The embodiments herein relate generally to devices used to display material samples.

Prior to embodiments of the disclosed invention, there was no efficient way to display cellular fabrics for window coverings. In particular solutions involved either having an attachment outside the fabric swatch or having a cover that needed to be manufactured over the swatch and the attachment to hold the fabrics down in a closed position. Embodiments of the disclosed invention resolve these problems.

SUMMARY

A sample display holder, configured to present a fabric covering. The sample display holder can include a backer board, mechanically coupled to a plurality of joined cellular material sample sections can further comprise a rear cellular material sample section mechanically coupled to the backer board and a front cellular material sample section mechanically coupled to a label. Each cellular material sample section can further comprise a cell mechanically coupled to and surrounded by the fabric covering. Each cell and each fabric covering can further comprise a front hole and a rear hole wherein all holes are aligned. A magnetic unit can be attached to the backer board and further comprising a mounting mechanically coupled to a magnet. A magnetic plate can be mechanically coupled to the front cellular material sample section. In a first mode of operation, the plurality of joined cellular material sample sections can be compressed by magnetically coupling the magnet to the magnetic plate. In a second mode of operation, the plurality of joined cellular material sample sections can be expanded by pulling the label away from the backer board.

In some embodiments, each cell and each fabric covering can be shaped as a modified quadrilateral having a front side and a rear side parallel to the backer board. The front side and the rear side can be joined with a top side and a bottom side which are configured to expand and collapse to accommodate the magnet.

In some embodiments, a display deck can be detachably coupled to the backer board. In some embodiments, the display deck can be detachably coupled to the backer board with a hook and loop fastener.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
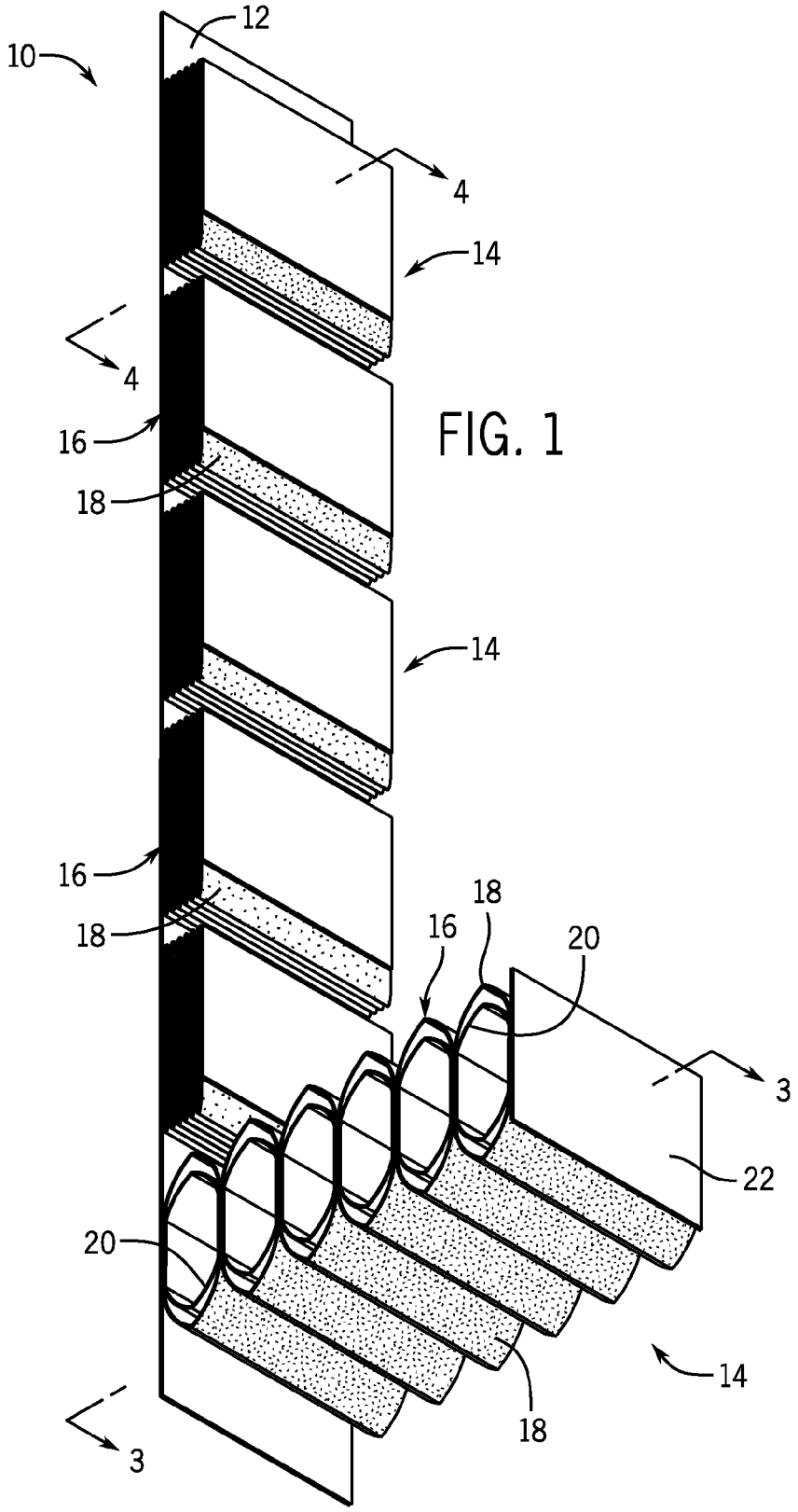
FIG. 1 is a perspective view of an embodiment of the invention, shown with some samples in an extended position.

By way of example, and referring to FIG. 1, one embodiment of sample display holder 10 comprises backer board 12. Backer board 12 is mechanically coupled to a plurality of display modules 14. Each display module 14 further comprises a plurality of joined cellular material sample sections 16. Each cellular material sample section 16 further comprises cell 20 mechanically coupled to and surrounded by fabric covering 18. Of the plurality of joined cellular material sample sections 16, there is a rear cellular material sample section 16 mechanically coupled to backer board 12 and a front cellular material sample section 16 mechanically coupled to label 22.

Figure 2:
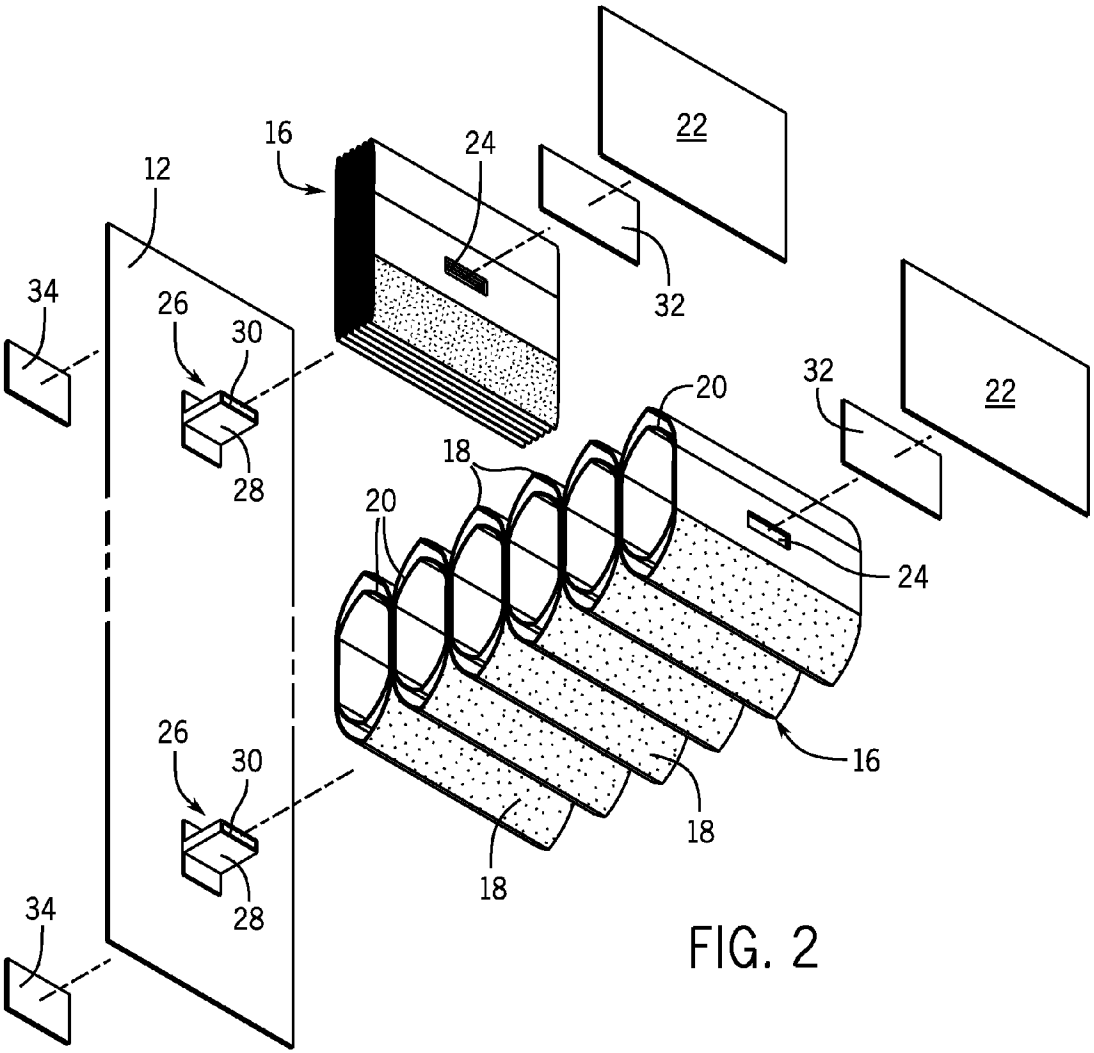
FIG. 2 is an exploded view of an embodiment of the invention.

FIG. 2 shows an assembly views of sample display holder 10. Each cell 20 and fabric covering 18 further comprises a front hole 24 and a rear hole 24 wherein all holes 24 are aligned. Backer board 12 is mechanically coupled to magnetic unit 26. Magnetic unit 26 comprises mounting 28 mechanically coupled to magnet 30. Front cellular material sample section 16 is mechanically coupled to magnetic plate 32.

Figure 3:
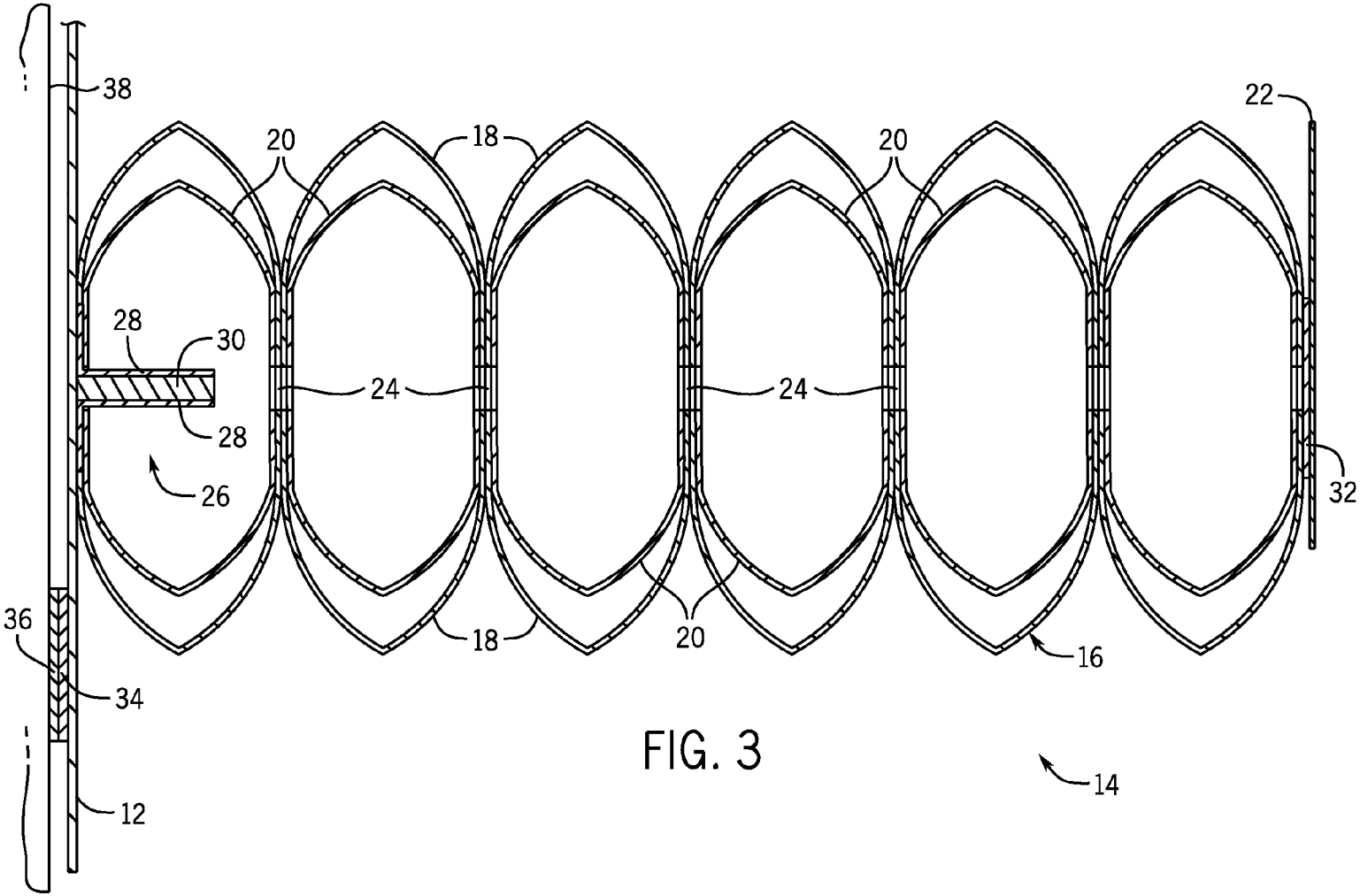
FIG. 3 is a detail section view of an embodiment of the invention, taken along line 3-3 in FIG. 1.

As shown in FIG. 3, backer board 12 is mechanically coupled to hook fastener 34. Display deck 38 is mechanically coupled to loop fastener 36. In this regard, backer board 12 is detachably coupled to display deck 38. Display deck 38 could stand alone in some embodiments or it could be a part of a book of samples. In either case, embodiments of the present invention facilitate displaying samples.

Mounting 28 is perpendicular to backer board 12 such that magnet 30 extends through each hole 24. Each cell 20 and each fabric covering 18 have a distinctive shape that enables this feature. The shape is a modified quadrilateral having a front side and a rear side parallel to backer board 12. The front side and the rear side are joined with a top side and a bottom side which are configured to expand and collapse.

Figure 4:
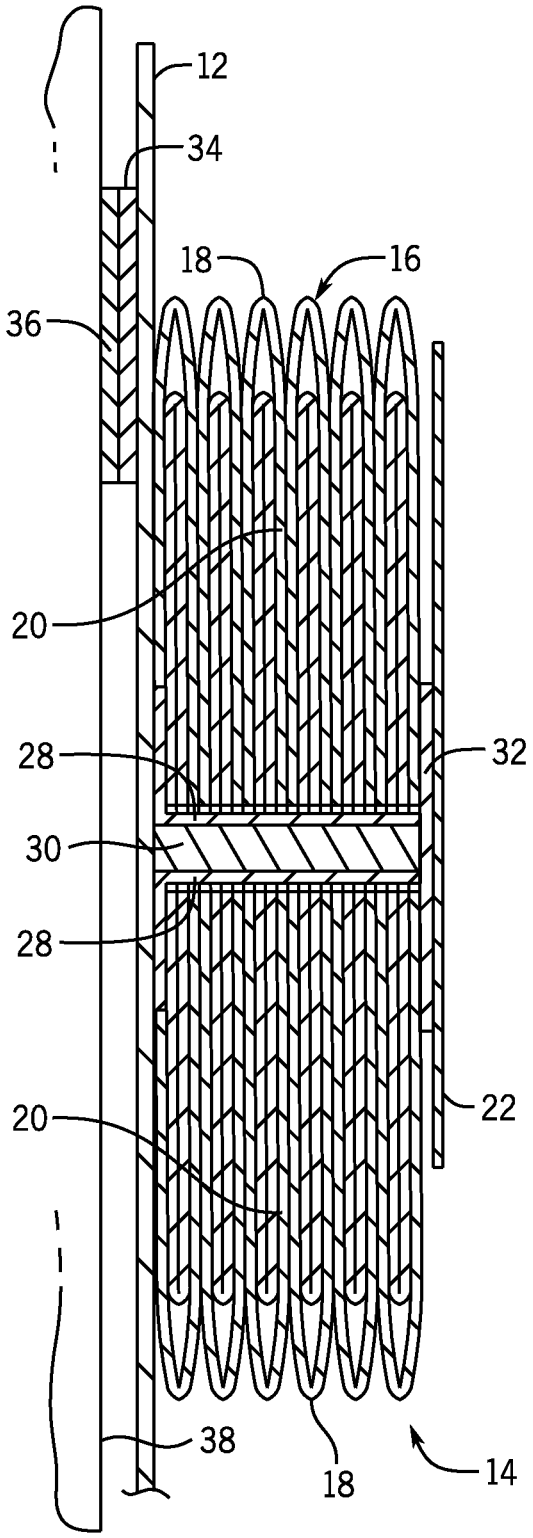
FIG. 4 is a detail section view of an embodiment of the invention, taken along line 4-4 in FIG. 1.

FIG. 3 and FIG. 4 demonstrate that, in a first mode of operation, to use sample display holder 10, a user simple pulls label 22 distant backer board 12. In a second mode of operation, to store sample display holder 10, a user then compresses label 22 proximate backer board 12 until magnetic plate 32 is magnetically coupled to magnet 30.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A sample display holder, configured to present a fabric covering; the sample display holder comprising:

a backer board, mechanically coupled to a plurality of joined cellular material sample sections further comprising a rear cellular material sample section mechanically coupled to the backer board and a front cellular material sample section mechanically coupled to a label;

wherein each cellular material sample section further comprises a cell and a fabric covering, the cell mechanically coupled to and surrounded by the fabric covering; wherein each cell and each fabric covering further comprises a front hole and a rear hole wherein all holes are aligned;

a magnetic unit, attached to the backer board and further comprising a mounting mechanically coupled to a magnet; and a magnetic plate mechanically coupled to the front cellular material sample section;

wherein a first mode of operation, the plurality of joined cellular material sample sections are compressed by magnetically coupling the magnet to the magnetic plate;

wherein a second mode of operation, the plurality of joined cellular material sample sections are expanded by pulling the label away from the backer board.

2. The sample display holder of claim 1, wherein each cell and each fabric covering are shaped as a modified quadrilateral having a front side and a rear side parallel to the backer board; the front side and the rear side are joined with a top side and a bottom side which are configured to expand and collapse to accommodate the magnet.

3. The sample display holder of claim 2, further comprising a display deck, detachably coupled to the backer board.

4. The sample display holder of claim 3, wherein the display deck is detachably coupled to the backer board with a hook and loop fastener.

* * * * *